US006786187B2

(12) United States Patent
Nagai et al.

(10) Patent No.: US 6,786,187 B2
(45) Date of Patent: Sep. 7, 2004

(54) INTERNAL COMBUSTION ENGINE

(75) Inventors: Noboru Nagai, Hachioji (JP); Yumin Liu, Fussa (JP)

(73) Assignee: Kioritz Corporation, Tokyo (JP)

( * ) Notice: Subject to any disclaimer, the term of this patent is extended or adjusted under 35 U.S.C. 154(b) by 98 days.

(21) Appl. No.: 09/865,544

(22) Filed: May 29, 2001

(65) Prior Publication Data

US 2001/0045199 A1 Nov. 29, 2001

(30) Foreign Application Priority Data

May 29, 2000 (JP) ..... 2000-157793

(51) Int. Cl.[7] ..... F01M 1/00

(52) U.S. Cl. ..... 123/196 R; 123/185.3; 184/1.5

(58) Field of Search ..... 123/196 R, 196 W, 123/185.3; 184/11.1, 1.5

(56) References Cited

U.S. PATENT DOCUMENTS 5,072,699 A * 12/1991 Pien ..... 123/65 VC
5,947,075 A 9/1999 Ryu et al.
6,510,829 B2 * 1/2003 Ito et al. ..... 123/196 R

FOREIGN PATENT DOCUMENTS

JP 09-170417 6/1997
JP 09-177528 7/1997
JP 10-288019 10/1998
JP 10-288020 10/1998

* cited by examiner

*Primary Examiner*—Tony M. Argenbright
*Assistant Examiner*—Katrina B. Harris
(74) *Attorney, Agent, or Firm*—Nixon Peabody LLP; Donald R. Studebaker

(57) ABSTRACT

An internal combustion engine capable of optimizing the amount of oil in the crank chamber with a simplified structure of lubrication system, in which a U-shaped oil reservoir is formed surrounding and adjacent to a crank chamber. At least one small hole is formed on a partition wall which separates the oil reservoir and the crank chamber from each other so that the crank chamber may always communicate with the oil reservoir through the small hole. Due to a flow resistance in the small hole, a pressure Po in the oil reservoir changes following a change of pressure Pc in the crank chamber with some delay, and where the pressure difference between the oil reservoir and the crank chamber caused by a delay in the change of the pressure Po in the oil reservoir, results in the introduction of the oil in the oil reservoir into the crank chamber. It further allows excessive oil in the crank chamber to be circulated back into the oil reservoir.

9 Claims, 5 Drawing Sheets

Po: PRESSURE IN THE OIL RESERVOIR 22

Pc: PRESSURE IN THE CRANK CHAMBER 20

Pv: PRESSURE IN THE VALVE GEAR CHAMBER 15

INTERNAL COMBUSTION ENGINE

BACKGROUND OF THE INVENTION

The present invention generally relates to an internal combustion engine and in particular, to an engine with excellent lubricity suitable for a power source of a small working machine including but not limited to a portable trimmer, a lawn mower, a chain saw or the like.

DESCRIPTION OF THE PRIOR ART

A portable type working machine represented by a portable trimmer as well as a chain saw is required to allow an operator to work without any restrictions on his working posture. Accordingly, an internal combustion engine as a power source mounted on such working machine must provide stable operation even if the machine is used in the working posture of, for example, a laterally tilted position.

In order to meet this requirement, there has been employed conventionally a compact air-cooled type two-stroke cycle gasoline engine (hereafter, the "two-stroke cycle engine") equipped with a diaphragm carburetor, which uses a mixed fuel oil composed of fuel and lubricant oil mixed at a certain ratio. The two-stroke cycle engine of this type, however, has a disadvantage in that it is difficult to reduce the exhaust gas or an emission gas since the exhaust gas therefrom contains a fair amount of unburned gas constituent due to a gas-flow type scavenging system employed therein.

As for other measures taken to reduce the emission gas, a four-stroke cycle internal combustion engine (Otto engine) has advantage over the two-stroke cycle engine because the former generates a small amount of unburned gas. Therefore, the four-stroke cycle engine has been looked into for employment in the portable working machine in place of the two-stroke cycle engine. The four-stroke cycle engine typically has an oil reservoir formed by an oil pan disposed in a bottom portion of a crank chamber accommodating a crankshaft, and employs a lubrication system in which a lubricating oil contained in this oil reservoir is pumped up by a pump and/or is splashed up by a rotary member, typically, so-called "an oil dipper" (Japanese Patent Laid-Open Disclosure No. Hei 9-177528).

Further, Japanese Patent Laid-Open Publications No. Hei 10-288019 and No. Hei 10-288020 disclose a system in which two communicating channels are provided between a crank chamber and an oil reservoir so as to allow them to communicate with each other, and an open/close valve constructed substantially by a channel formed inside a crankshaft is provided in one of the communicating channels. In the other communicating channel, a reed valve is installed so that, when the pressure in the crank chamber is made negative with the upward motion of an ascending piston, the open/close valve is opened and the reed valve is closed, whereby the oil in the oil reservoir is supplied into the crank chamber through the one communicating channel. On the other hand, when the pressure in the oil reservoir is made positive with the downward motion of a descending piston, the open/close valve is closed and the reed valve is opened and whereby the pressure in the oil reservoir is made positive.

Further, Japanese Patent Laid-open Publication No. Hei 9-170417 discloses a lubrication system in which a crank chamber and an oil reservoir always communicate with each other, a valve chamber (pressure regulating chamber) located adjacent to the crank chamber is made to communicate with a valve gear chamber (the pressure therein is maintained to be substantially equal to atmospheric pressure), and a reed valve is disposed in a communicating channel between the valve space and the crank chamber, so that the reed valve is opened when the pressure in the crank chamber is being raised while a piston descends. The lubrication system disclosed in this Japanese Patent Laid-open Publication Disclosure No. Hei 9-170417 draws the engine oil within the oil reservoir into the crank chamber by always maintaining a negative pressure condition inside the crank chamber.

A lubrication system using the oil pump, however, is not suitable for an engine of the portable working machine since an additional mechanism for discharging and recovering the lubricating oil has to be employed and thus would make the system complicated and heavy. On the other hand, a lubrication system using the oil dipper has shortcomings as well in that it is difficult to determine a length of the oil dipper during a designing stage of the engine. That is, if the length of the oil dipper is designed to be too short, a desired degree of oil lubrication may become difficult to be supplied by the oil dipper within a short period of time after starting due to an oil consumption. On the contrary, if the length of the oil dipper is designed to be too long, a large amount of oil may be splashed up by the oil dipper immediately after the oil has been filled into the oil pan making a mist of oil in the crank chamber too rich (to reach to excessive level) possibly resulting in a problematic level of pollution created by the blow-by gas.

Further, although either lubrication system disclosed in Japanese Patent Laid-open Publications No. Hei 10-288019, Hei 10-288020, or Hei 9-170417 uses a check valve such as a reed valve as an indispensable component, the reed valve is likely to result in problems associated with its durability since this type of engine is driven at an extremely high speed, that is, even the normal revolution number of which is as high as 7500 rpm, and in addition, there is another risk in the high revolution driving range that the valve may possibly fail to operate as intended in the design stage because the valve is likely to be kept substantially open all the time.

The present invention has been devised during a process in the technology development activity attempting to improve the lubrication system of an oil dipper type engine in response to the present environmental and social concerns surrounding the engine for use as a portable working machine.

An advantage of the present invention is to provide an internal combustion engine with an innovative lubrication system different from the conventional one.

Another advantage of the present invention is to provide an internal combustion engine in which the amount of oil in a crank chamber can be optimized while making an engine lubrication structure simpler.

Another advantage of the present invention is to provide an internal combustion engine which does not require use of a check valve, such as a reed valve, as an indispensable component thereof.

Another advantage of the present invention is to provide an internal combustion engine which can effectively lubricate itself without requiring another power source.

SUMMARY OF THE INVENTION

According to the present invention, the technological advantages described above can be achieved by an innovative internal combustion engine, comprising: a crankshaft; a crank chamber accommodating the crankshaft; an oil reservoir arranged adjacent to the crank chamber; with the crank chamber and the oil reservoir being in communication with each other via a communicating channel having a flow resistance, so that the flow resistance in the communicating channel causes a pressure in the oil reservoir to change with a delay with respect to the change of a pressure in the crank chamber, the pressure difference between the crank chamber and the oil reservoir causing a fluid flow through the communicating channel between the crank chamber and the oil reservoir.

In an exemplary embodiment of the present invention, the crank chamber and the oil reservoir are separated from each other by a partition wall, and the communicating channel having the flow resistance is a small hole formed in the partition wall.

Further, in addition to this small hole, a suction tube extending from the partition wall into the engine oil in the oil reservoir may be provided on the partition wall so that the crank chamber may communicate with the oil reservoir through the suction tube and the small hole.

Since the suction tube extends into the engine oil in the oil reservoir, the oil is supplied as liquid through the suction tube into the crank chamber. The engine oil supplied into the crank chamber is then atomized by a rotating member such as the crankshaft or the like disposed in the crank chamber.

Other advantages, features and effects of the present invention will be more fully apparent from a reading of the following detailed description of preferable embodiments in conjunction with the accompanying drawings.

DESCRIPTION OF THE PREFERRED EMBODIMENTS OF THE PRESENT INVENTION

Figure 1:
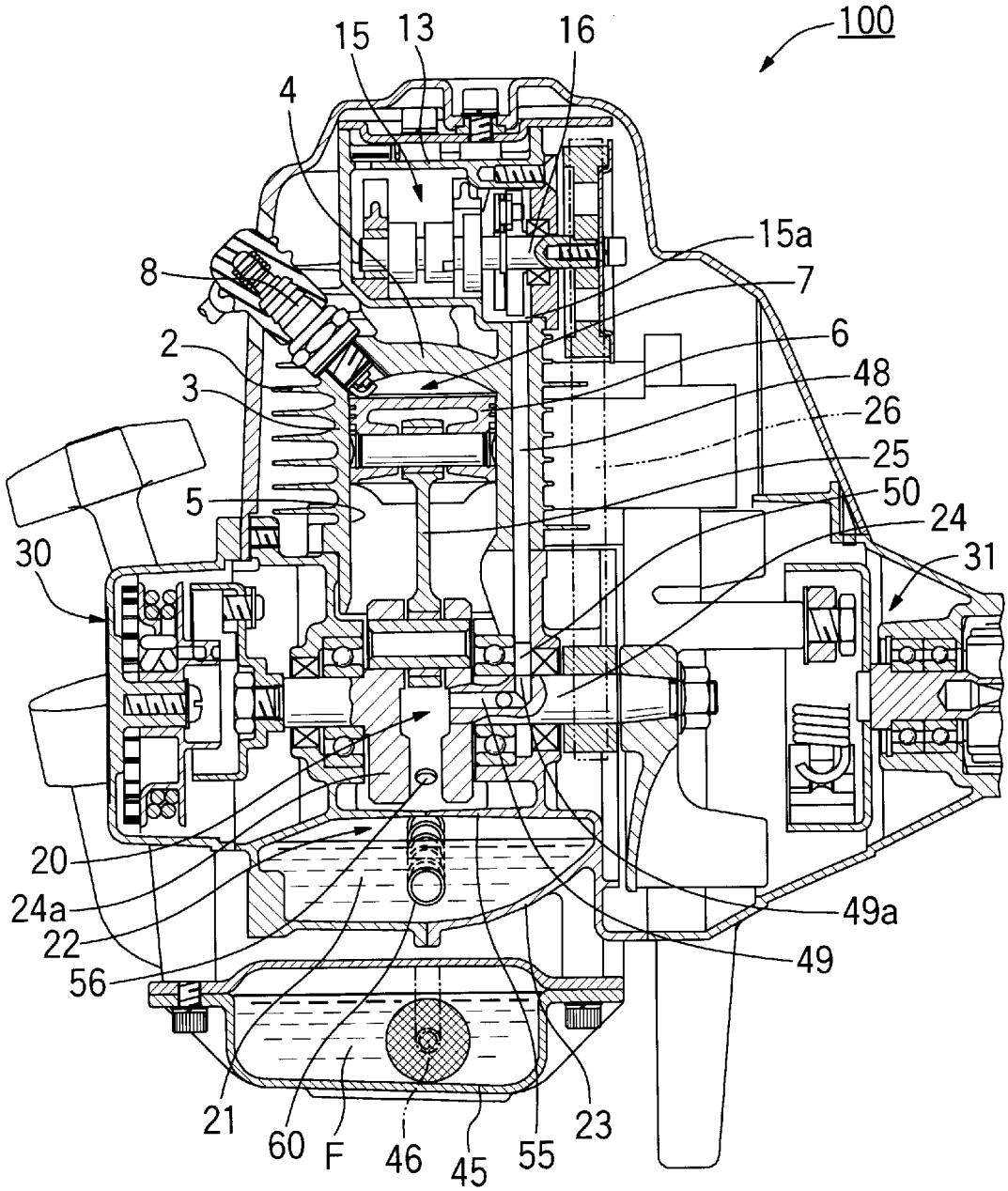
FIG. 1 is a longitudinal cross-sectional view taken along a plane including an axial line of a crankshaft, illustrating an engine in accordance with an initial embodiment of the present invention.

Preferred embodiments of the present invention will now be described in detail with reference to the attached drawings.

Initial Embodiment (FIG. 1 to FIG. 4)

An engine 100 shown in FIGS. 1–4 is of a relatively compact type with a displacement of about 20 to 50 ml, which may be employed, for example, as a power source for a portable trimmer. The engine 100 comprises a cylinder block 3 with cooling fins 2 formed thereon for air-cooling, and a cylinder head 4 disposed thereon, wherein a combustion chamber 7 is defined between the cylinder head 4 and a piston 6 fittingly inserted into a cylinder bore 5 formed in the cylinder block 3 to be slidably movable in an up-and-down direction.

The cylinder head 4 is equipped with an ignition plug 8 (FIG. 1) arranged to face the combustion chamber 7, and an intake port 9 and an exhaust port 10 each opening to the combustion chamber 7 (FIG. 2), wherein the intake port 9 is opened and closed by an intake valve 11 while the exhaust port 10 is opened and closed by an exhaust valve 12.

Figure 2:
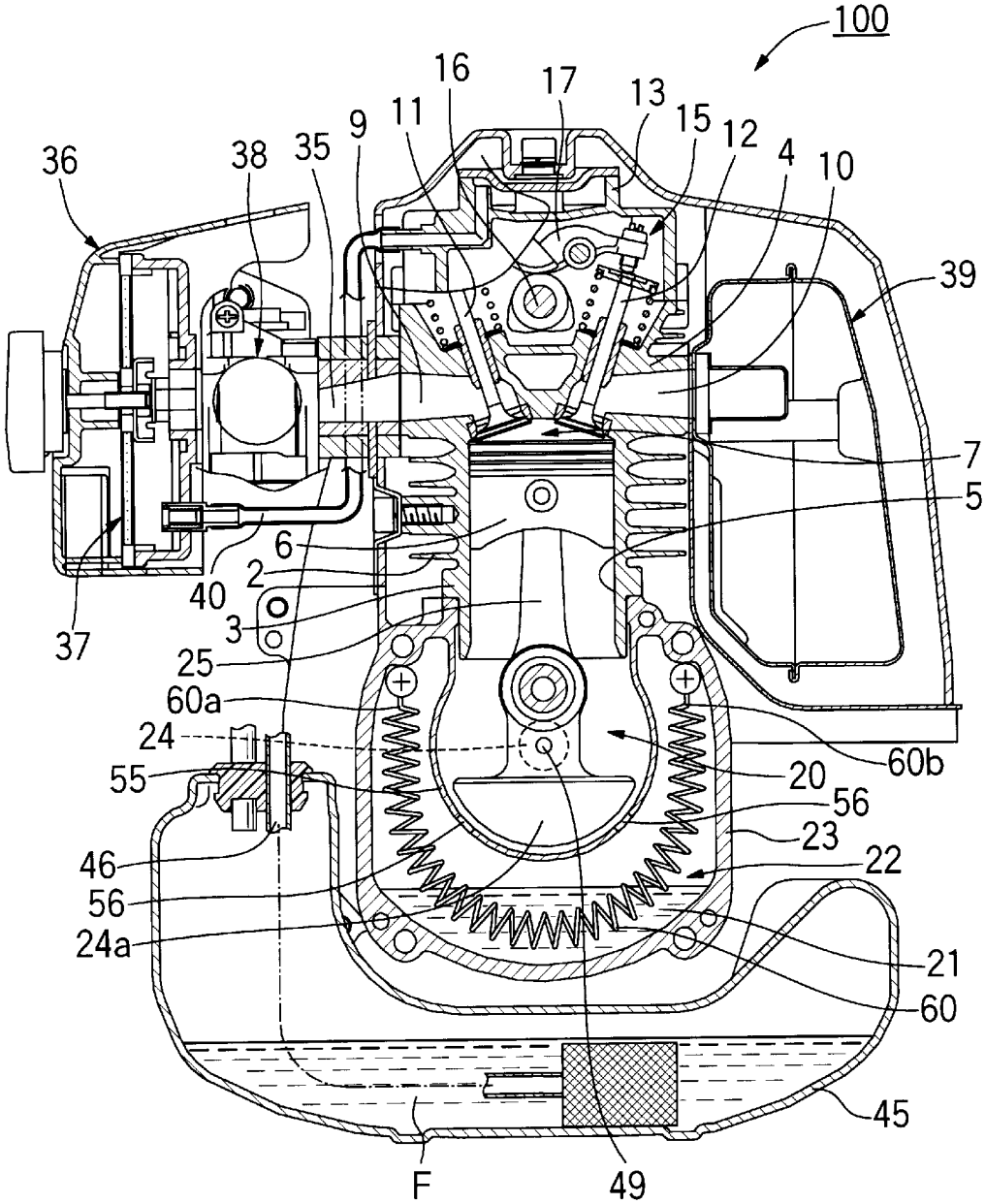
FIG. 2 is another longitudinal cross-sectional view taken along a plane crossing the crankshaft at a right angle, illustrating the same engine as shown in FIG. 1.

The engine 100 shown in these drawings has a valve gear chamber 15 for accommodating a valve mechanism, defined by the cylinder head 4 and a head cover 13 arranged above the cylinder head 4. The valve mechanism comprises, as conventionally well known, a camshaft 16 and a rocker arm 17 or the like (FIG. 2). As can be seen from these facts, the engine 100 is considered as an OHC engine.

A crankcase 23 is disposed on a lower end of the cylinder block 3 to form a crank chamber 20 and an oil reservoir 22 for storing an engine oil 21, wherein a crankshaft 24 or an engine output shaft disposed in the crank chamber 20 is operatively connected with the piston 6 via a connecting rod 25. The crank chamber 20 and the oil reservoir 22 will be described in detail later.

The crankshaft 24 is operatively connected with the camshaft 16 via a timing belt 26 (FIG. 1), so that the intake valve 11 and the exhaust valve 12 are opened and closed in a predetermined timing synchronous with a rotation of the crankshaft 24.

In FIG. 1, reference numeral 30 designates a recoil starter, which is operatively engaged with the crankshaft 24. When starting, the engine 100 is actuated by operating the recoil starter 30 by hand. Further, reference numeral 31 (FIG. 1) indicates a centrifugal clutch, which transmits the rotary driving force of the crankshaft 24 to a cutting blade device, though not shown.

As shown in FIG. 2, an intake system component 36 is connected to the intake port 9 by way of an intake channel 35 communicating with the intake port 9. The intake system component 36 comprises an air cleaner 37, and a diaphragm type carburetor 38 or a fuel supply means including a throttle valve (not shown). On the other hand, an exhaust system component 39 including a muffler is connected to the exhaust port 10. The air cleaner 37 communicates with the valve gear chamber 15 through a tube 40, whereby a blow-by gas introduced into the valve gear chamber 15 from the crank chamber 20 is exhausted through the tube 40 into the air cleaner 37 on a downstream side of an air intake.

A fuel tank 45 is arranged below the engine 100 adjacent to the crankcase 23, which contains a gasoline or a fuel F. The fuel F contained in the fuel tank 45 is supplied via a piping 46 to the carburetor 38 to be atomized therein as an air-fuel mixture, and then is sent through the intake channel 35 and the intake port 9 to charge the combustion chamber 7.

The engine 100 further has a plurality of communicating channels 48 for making the crank chamber 20 communicate with the valve gear chamber 15 (only one communicating channel is shown in FIG. 1). The plurality of these communicating channels 48 are formed of slender holes extending through a wall of the cylinder block 3 in an up-and-down direction. For example, four through holes may be arranged in the cylinder block 3 having a distance therebetween in a circumferential direction. The communicating channel 48 shown in FIG. 1 is different from other communicating channels (not shown) in respect that a top end thereof is open to a recess 15*a* formed on a bottom wall of the valve gear chamber 15 (FIG. 1).

The lower ends of the plurality of the communicating channels 48 communicate with an annular chamber 50 leading to an inner channel 49 which is formed in the crankshaft 24 and is open to the crank chamber 20 (FIG. 1). The inner channel 49 of the crankshaft 24 has a port 49*a* radially facing to the annular chamber 50, and accordingly the crank chamber 20 always communicates with the annular chamber 50 through the port 49*a* and the inner channel 49.

As for the crank chamber 20 and the oil reservoir 22 mentioned above, a space in the crankcase 23 is separated into the crank chamber 20 and the oil reservoir 22 by a partition wall 55. The partition wall 55, as best seen from FIG. 2, is formed into an arc shape about a rotational axis of the crankshaft 24. It extends along a locus of a movement of and in close proximity to a balance weight 24*a* of the crankshaft 24, and whereby, the U-shaped oil reservoir 22 is formed so as to be arranged surrounding the crank chamber 20. The partition wall 55 has one or more small holes 56 (FIG. 2). The small hole 56 serves as a communicating channel for placing the crank chamber 20 in communication with the oil reservoir 22. That is, the crank chamber 20 always communicates with the oil reservoir 22 through the small hole 56.

Although, a coil spring 60 or a vibration member is disposed in the oil reservoir 22 and is suspended in a U-shape as an auxiliary means for constantly ruffling or agitating the oil 21 in the oil reservoir 22 at a suitable level, the coil spring 60 is not necessarily an indispensable component. The coil spring 60 is held at respective ends 60*a*, 60*b* thereof at right and left top end portions of the crankcase 23 so as to be suspended along the U-shaped oil reservoir 22. That is, the coil spring 60 is suspended in a U-shape in the oil reservoir 22.

The engine 100 so constructed as stated herein-above is operated in the same manner as a conventional four-stroke cycle internal combustion engine reciprocally repeating a series of strokes consisting of an intake stroke, a compression stroke, an expansion stroke and an exhaust stroke, which makes the up-and-down motion of the piston 6 to generate a change in the pressure Pc in the crank chamber 20, which in turn causes a fluid flow between the oil reservoir 22 and the crank chamber 20 and also a fluid circulation between the crank chamber 20 and the valve gear chamber 15 through the communicating channel 48.

An engine vibration caused by the operation of the engine 100 firstly induces an oscillation of the coil spring 60 in the oil reservoir 22, and the oscillating coil spring 60 stirs the engine oil 21 in the oil reservoir 22 and/or splashes it up and ruffles or agitates the entire oil surface. Since the coil spring 60 is arranged throughout the oil reservoir 22 surrounding the crank chamber 20 formed into U-shaped, the oscillating coil spring 60 vibrated by the engine vibration can stir the engine oil 21 in the oil reservoir 22 and/or splashes the oil and ruffles or agitates the entire oil surface even if the engine 100 is operated under, for example, a horizontally tilted condition or an upside-down condition.

Figure 4:
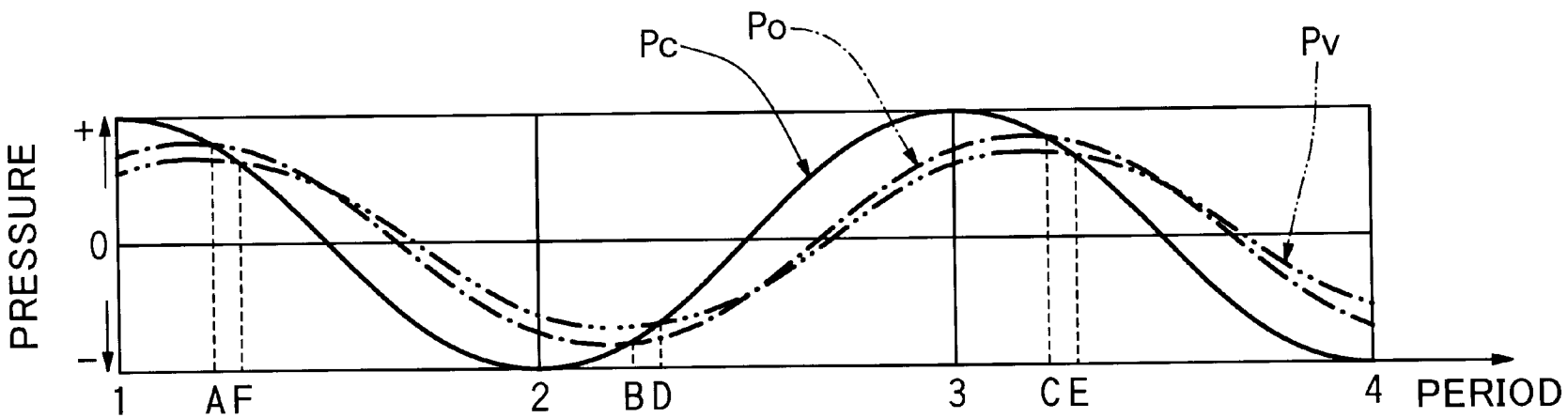
FIG. 4 is a diagram describing the pressure changes in the oil reservoir, the crank chamber, and the valve gear chamber caused by the up-and-down movement of a piston.

Referring to FIG. 4, a relation between the pressure Po in the oil reservoir 22 and the pressure Pc in the crank chamber 20, and a relation between the pressure Pc in the crank chamber 20 and the pressure Pv in the valve gear chamber 15 will now be described. In FIG. 4, a period from 1 to 2 corresponds to a stroke where the piston 6 is ascending, a period from 2 to 3 corresponds to a stroke where the piston 6 is descending, and a period from 3 to 4 corresponds to a stroke where the piston 6 is again ascending.

As can be seen from FIG. 4, there is a phase difference between the change in the pressure Pc in the crank chamber 20 caused by the up-and-down motion of the piston 6 (shown by a solid line) and the change in the pressure Po in the oil reservoir 22 (shown by a chain line). Also there is a phase difference between the change in the pressure Pc in the crank chamber 20 and the change in the pressure Pv in the valve gear chamber 15 (shown by a two-dot chain line). In other words, there appear changes in the pressure Po of the oil reservoir 22 and in the pressure Pv of the valve gear chamber 15, with certain delays with respect to the pressure change in Pc of the crank chamber 20 caused by the up-and-down motion of the piston 6.

These phase lags are caused by the flow resistance in the slender communicating channel 48 connecting the crank chamber 20 with the valve gear chamber 15, and further, by the flow resistance in the small hole 56 connecting the oil reservoir 22 with the crank chamber 20. That is, the small hole 56 is configured as a hole with an effective open area capable of causing a delay in the change of the inner pressure Po in the oil reservoir 22, this type of hole is generally known as an orifice. In place of the small hole 56, a channel having a diameter and/or a length capable of generating a flow resistance may be employed between the crank chamber 20 and the oil reservoir 22.

Referring again to FIG. 4, a period from a point A to a point B corresponds to a period during a time while the piston 6 ascends toward a top dead center before it starts descending therefrom. In this period, the inner pressure Pc in the crank chamber 20 changes from positive to negative, and the inner pressure Po in the oil reservoir 22 changes following the pressure change of Pc with some delay. Therefore, the pressure Po in the oil reservoir 22 is relatively higher than the pressure Pc in the crank chamber 20. This pressure difference (Po−Pc) induces the fluid in the oil reservoir 22 to flow into the crank chamber 20 through the small hole 56.

A period from the point B to a point C in FIG. 4 corresponds to a period during a time while the piston 6 descends toward the bottom dead center before it starts ascending therefrom. In this period, the inner pressure Pc in the crank chamber 20 changes from negative to positive, and the inner pressure Po in the oil reservoir 22 changes following the pressure change of Pc with some delay. Therefore, the pressure Po in the oil reservoir 22 is relatively lower than the pressure Pc in the crank chamber 20. This pressure difference (Pc−Po) induces the fluid in the crank chamber 20 to flow into the oil reservoir 22 through the small hole 56.

In FIG. 4, during a period from a point F to a point D, which substantially overlaps the period from point A to point B described above, the inner pressure Pc in the crank chamber 20 changes from positive to negative as described above, and the inner pressure Pv in the valve gear chamber 15 changes following the pressure change of Pc with some delay. Accordingly, the pressure Pv in the valve gear chamber 15 is relatively higher than the pressure Pc in the crank chamber 20. This pressure difference (Pv−Pc) promotes the liquefied engine oil, which mainly exists in the recess 15*a* of the valve gear chamber 15, to be circulated back to the crank chamber 20 through the communicating channel 48 and then through the port 49*a* and the inner channel 49 of the crankshaft 24.

In FIG. 4, during a period from point D to a point E, which substantially overlaps the period from point B to point C described above, the inner pressure Pc in the crank chamber 20 changes from negative to positive as described above, the inner pressure Pv in the valve gear chamber 15 changes following the pressure change of Pc with some delay. Accordingly, the pressure Pv in the valve gear chamber 15 is relatively lower than the pressure Pc in the crank chamber 20. This pressure difference (Pc−Pv) promotes the atomized engine oil in the crank chamber 20 to flow into the valve gear chamber 15 through the communicating channel 48.

Accordingly, a fine droplet of engine oil 21 in the oil reservoir 22 is introduced into the crank chamber 20 through the small hole 56 on the partition wall 55 during the period from point A to point B where the pressure Po in the oil reservoir 22 is relatively higher than the pressure Pc in the crank chamber 20, and then impinges against the rotating crankshaft 24 or the like to be atomized into the mist in the crank chamber 20, and eventually to contribute as an oil mist to a lubrication of a bearing of the crankshaft 24 or the like.

Further, the excessive oil in the crank chamber 20 is circulated back from the crank chamber 20 into the oil reservoir 22 through the small hole 56 on the partition wall 55 during the period from point B to point C where the pressure Po in the oil reservoir 22 is relatively lower than the pressure Pc in the crank chamber 20.

On the other hand, the oil mist in the crank chamber 20 enters the valve gear chamber 15 during the period from point D to point E where the pressure Pv in the valve gear chamber 15 is relatively lower than the pressure Pc in the crank chamber 20, so as to contribute to a lubrication of the valve mechanism.

The liquefied oil in the valve gear chamber 15 is collected in the recess 15*a* of the valve gear chamber 15. The oil in the recess 15*a* is circulated back into the crank chamber 20 through the communicating channel 48 and then through the port 49*a* and the inner channel 49 of the crankshaft 24 during the period from point F to point D where the pressure Pv in the valve gear chamber 15 is relatively higher than the pressure Pc in the crank chamber 20.

Therefore, according to an engine 100 of the initial embodiment described above, since the oil reservoir 22 and the crank chamber 20 which are separated by the partition wall 55 are always in communication with each other through the small hole 56, the flow resistance by the small hole 56 causes the change of the inner pressure Po in the oil reservoir 22 to be delayed from the change of the pressure Pc in the crank chamber 20, and the pressure difference (Po−Pc) between the pressure in the oil reservoir 22 and that in the crank chamber 20, which is generated by the delayed change in the pressure Po in the oil reservoir 22, causes the oil in the oil reservoir 22 to be introduced into the crank chamber 20 and also causes the excessive oil in the crank chamber 20 to be circulated back into the oil reservoir 22. This allows an amount of the oil in the crank chamber 20 to be properly controlled automatically and thereby makes it possible to improve the pollution problem of the blow-by gas possibly caused by the excessive oil in the crank chamber 20.

Further, the engine vibration ruffles or agitates the entire oil surface of the oil 21 in the oil reservoir 22. The ruffle or agitation of the oil surface is enhanced by the oscillation of the coil spring 60 which is induced by the engine vibration. In addition, since the coil spring 60 is arranged throughout the oil reservoir 22 formed into U-shaped surrounding the crank chamber 20, the oscillating coil spring 60 excited by the engine vibration can make the engine oil 21 in the oil reservoir 22 into fine droplets even if the engine 100 is, for example, tilted horizontally or turned upside-down. Although this coil spring 60 has an effect on atomizing the oil in the crank chamber 20 at an idle speed or at a specific required revolution, the coil spring 60 may be omitted.

According to the engine 100, the amount of the engine oil 21 in the oil reservoir 22 can be reduced as compared with that in the lubrication system by a conventional oil dipper type engine. Since the engine 100 is designed such that the oil in the oil reservoir 22 flows into the crank chamber 20 owing to the pressure difference (Po−Pc) between the oil reservoir 22 and the crank chamber 20, the crank chamber 20 can effectively be lubricated even if the amount of oil in the oil reservoir 20 is decreased.

Figure 3:
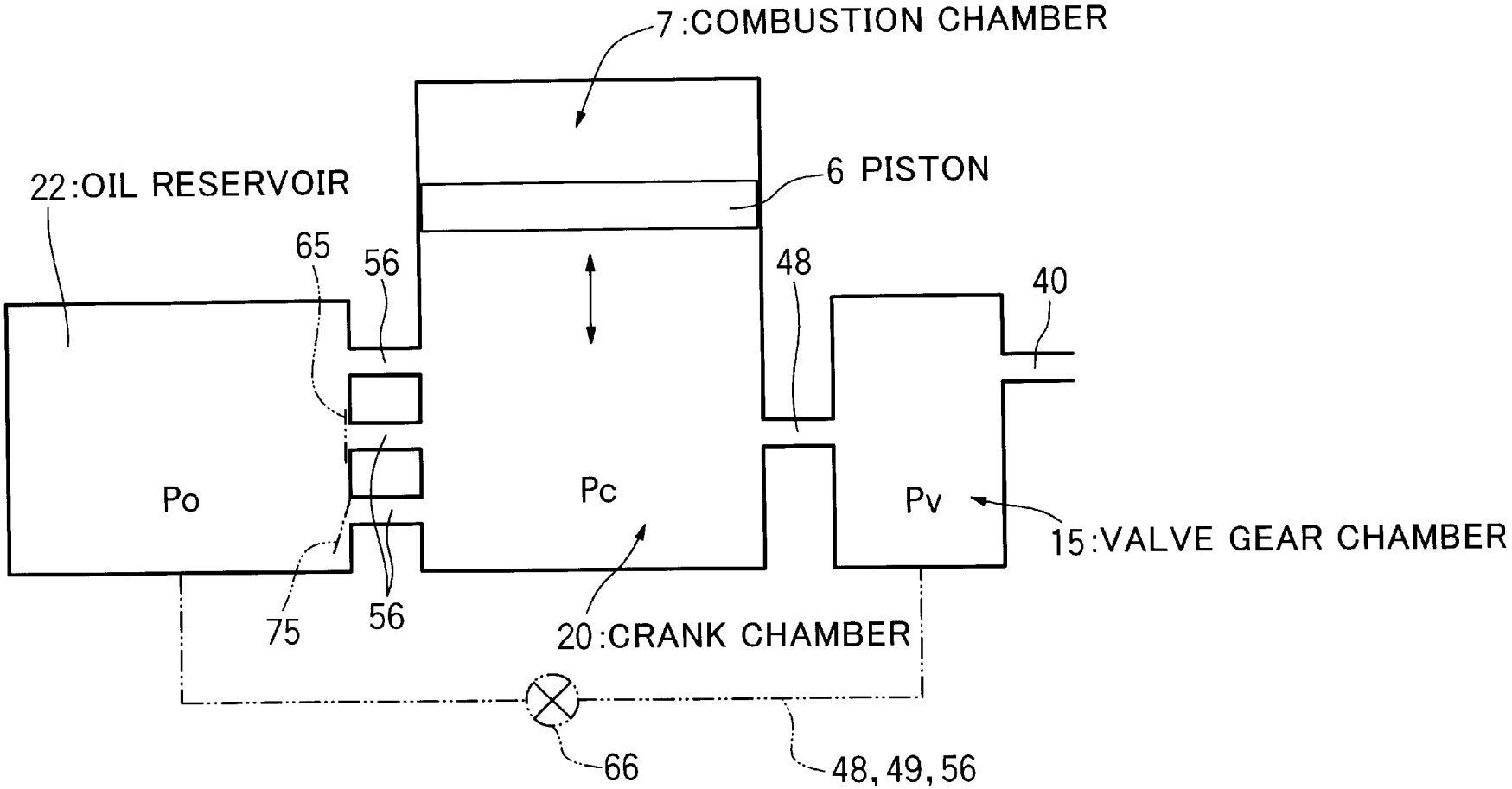
FIG. 3 is a diagram illustrating the principle of the present invention corresponding to the engine of the initial embodiment.

When the amount of oil flowing from the oil reservoir 22 into the crank chamber 20 is greater than the necessary amount, that is, the oil in the crank chamber 20 is rather rich, a mesh material such as a metal net 65 or a porous material may be provided on the small hole 56 as indicated by a chain line in FIG. 3 so that the amount of oil flowing from oil reservoir 22 into the crank chamber 20 may be controlled. In this case, when a plurality of small holes 56 is provided on the partition wall 55, the metal mesh 65 may be installed on at least one of the plurality of small holes 56.

In the engine 100, a check valve such as a reed valve (a member 66 shown in by a chain line in FIG. 3) may be installed on the communicating channel 48 for connecting the crank chamber 20 with the valve gear chamber 15 so that a fluid flow from the crank chamber 20 to the valve gear chamber 15 may be allowed but the fluid flow in the reverse direction is prohibited. Further, a check valve 75 such as a reed valve may be installed on at least one of the small holes 56 connecting the oil reservoir 22 with the crank chamber 20 so that a fluid flow from the oil reservoir 22 to the crank chamber 20 may be allowed but the fluid flow in the reverse direction is prohibited.

Further, when a vibration member such as the coil spring 60 is arranged in the oil reservoir 22 so as to be oscillated by the engine vibration, it may be designed to have a natural frequency to resonate at a specified engine revolution number (for example, that at the idle running speed).

Figure 5:
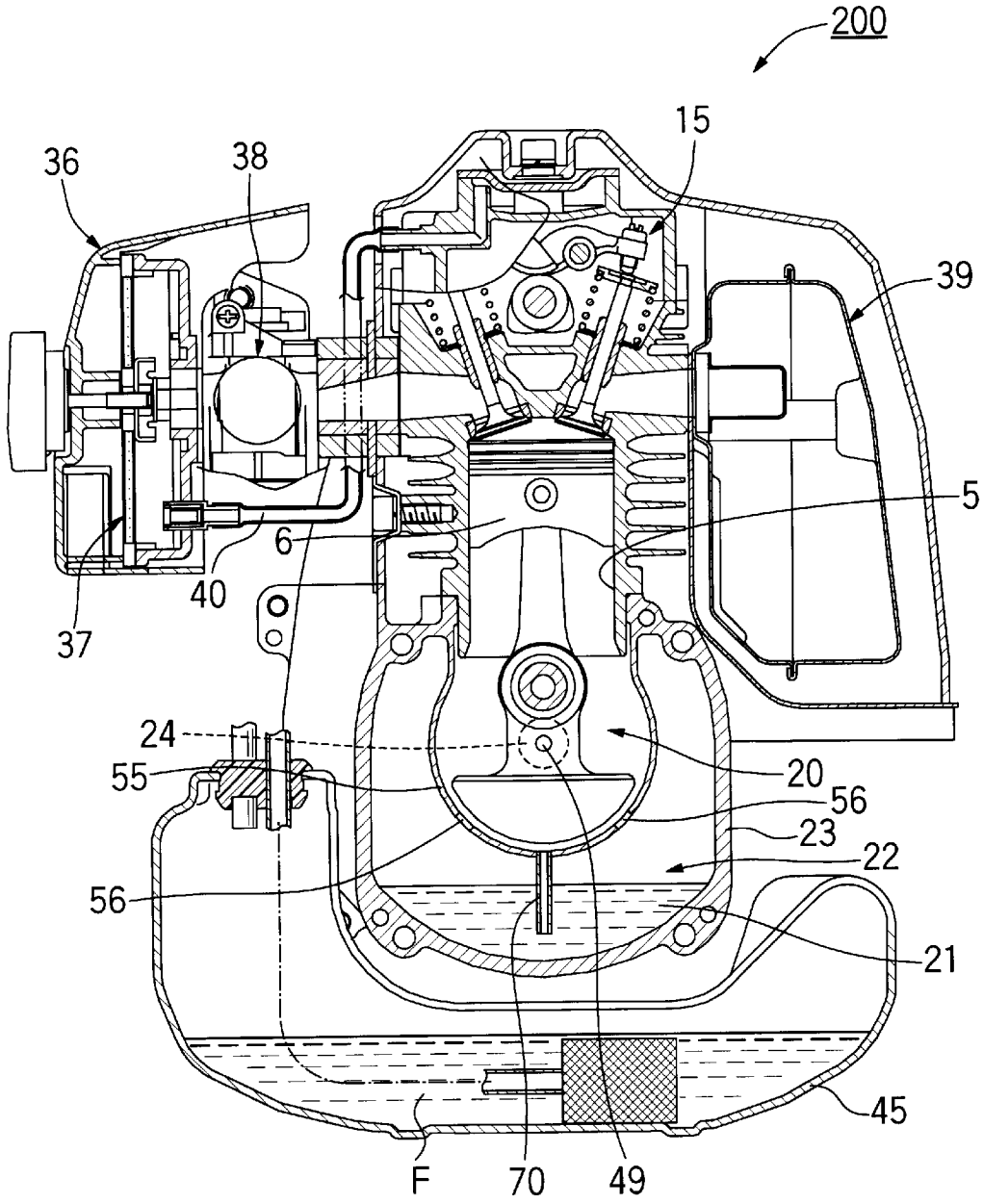
FIG. 5 is a longitudinal cross-sectional view taken along a plane crossing the crankshaft at right angle, illustrating an engine according to an alternative embodiment of the present invention.

Alternative Embodiment (FIG. 5)

FIG. 5 is a longitudinal cross-sectional view taken along a plane crossing the crankshaft at right angle, illustrating an alternative embodiment of an air-cooled four stroke cycle single cylinder internal combustion engine to which the present invention is applied. In the description of the engine 200 in accordance with the alternative embodiment, the components equivalent to those in the engine 100 of the initial embodiment are indicated by the similar reference numerals so that the detailed description therefor may be omitted, and different portions and features of the engine 200 of the alternative embodiment will now be described.

In the engine 200 shown in FIG. 5, a suction tube 70 is provided on the partition wall 55 in addition to the small holes 56, so that the crank chamber 20 may also communicate with the oil reservoir 22 through the suction tube 70. The suction tube 70 extends from the partition wall 55 downward along an axis line of the cylinder bore 5, and is long enough to enter into the engine oil 21 in the oil reservoir 22.

The suction tube 70 may be made of rigid material as well as of flexible material. When the suction tube 70 is made of flexible material, there may be provided a weight at a front end of the flexible suction tube 70 so that the flexible suction tube 70 can enter into the engine oil 21 in the oil reservoir 22 regardless of the posture of the engine 200, that is, even if the engine 200 is tilted laterally or is turned upside down.

According to the engine 200 of the alternative embodiment shown in FIG. 5, as to the engine oil 21 in the oil reservoir 22, during the period from point A to point B (FIG. 4) where the pressure Po in the oil reservoir 22 is relatively higher than the pressure Pc in the crank chamber 20, the droplets of oil flow through the small hole 56 on the partition wall 55 into the crank chamber 20 and also the oil 21 of liquid phase is sucked through the suction tube 70 into the crank chamber 20 where the oil impinges the rotating crankshaft 24 or the like to be made into oil mist, thus to contribute to lubricating the bearing of the crankshaft 24 or the like.

The excessive oil in the crank chamber 20 is circulated back from the crank chamber 20 to the oil reservoir 22 through the small hole 56 and the suction tube 70 during the period from point B to point C where the pressure Po in the oil reservoir 22 is relatively lower than the pressure Pc in the crank chamber 20.

Also in the engine 200 of the alternative embodiment shown in FIG. 5, a vibration means such as a coil spring 60 may be employed as an auxiliary means, which is oscillated by the engine vibration to assist the engine oil 21 in the oil reservoir 22 to be made into fine droplets.

Although the present invention has been described based on the embodiments of a four-stroke cycle internal combustion engine, it will be apparent to those skilled in the art that the lubrication system of the present invention may be applied also to a two-stroke cycle internal combustion engine. When the lubrication system of the present invention is applied to the two-stroke cycle internal combustion engine, the fuel containing no engine oil or the mixed fuel with an extremely small amount of engine oil may be supplied to the engine.

What is claimed is:

1. An internal combustion engine, comprising:

a crankshaft;

a crank chamber accommodating said crankshaft;

an oil reservoir arranged adjacent to said crank chamber and containing engine oil;

at least one communicating channel having a flow resistance disposed between said crank chamber and said oil reservoir, said crank chamber and said oil reservoir being separated from each other by a partition wall, and said at least one communicating channel having said flow resistance comprising an orifice formed in said partition wall, said crank chamber and said oil reservoir always communicating with each other through said orifice, wherein said crank chamber and said oil reservoir are in communication with each other by way of said communicating channel, so that said flow resistance in said communicating channel causes a pressure in said oil reservoir to change with a delay with respect to a change in pressure in said crank chamber, a pressure difference between said crank chamber and said oil reservoir causing a fluid flow through said communicating channel from said crank chamber to said oil reservoir in a first instance and from said oil reservoir to said crank chamber in a second instance; and a suction tube provided on said partition wall, said suction tube extending from said partition wall into the engine oil in said oil reservoir.

2. An internal combustion engine, comprising:

a crankshaft;

a crank chamber accommodating said crankshaft;

an oil reservoir arranged adjacent to said crank chamber and containing engine oil; and at least one communicating channel having a flow resistance disposed between said crank chamber and said oil reservoir, said crank chamber and said oil reservoir being separated from each other by a partition wall, and said at least one communicating channel having said flow resistance comprising an orifice formed in said partition wall, said crank chamber and said oil reservoir always communicating with each other through said orifice, wherein said crank chamber and said oil reservoir are in communication with each other by way of said communicating channel,so that said flow resistance in said communicating channel causes a pressure in said oil reservoir to change with a delay with respect to a change in pressure in said crank chamber, a pressure difference between said crank chamber and said oil reservoir causing a fluid flow through said communicating channel from said crank chamber to said oil reservoir in a first instance and from said oil reservoir to said crank chamber in a second instance;

wherein said partition wall includes a plurality of orifices and a porous material is provided in at least one of said plurality of orifices.

3. An internal combustion engine in accordance with claim 1, wherein said partition wall includes a plurality of orifices and a porous material is provided in at least one of said plurality of orifices.

4. An internal combustion engine, comprising:

a crankshaft;

a crank chamber accommodating said crankshaft;

an oil reservoir arranged adjacent to said crank chamber and containing engine oil;

at least one communicating channel having a flow resistance disposed between said crank chamber and said oil reservoir, said crank chamber and said oil reservoir being separated from each other by a partition wall, and said at least one communicating channel having said flow resistance comprising an orifice formed in said partition wall, said crank chamber and said oil reservoir always communicating with each other through said orifice, wherein said crank chamber and said oil reservoir and in communication with each other by way of said communicating channel, so that said flow resistance in said communicating channel causes a pressure in said oil reservoir to change with a delay with respect to a change in pressure in said crank chamber, a pressure difference between said crank chamber and said oil reservoir causing a fluid flow through said communicating channel from said crank chamber to said oil reservoir in a first instance and from said oil reservoir to said crank chamber in a second instance; and a vibration member extending into said oil reservoir, wherein said vibration member is vibrated by operation of the engine.

5. An internal combustion engine in accordance with claim 1, further comprising a vibration member extending into said oil reservoir, wherein said vibration member is vibrated by operation of the engine.

6. An internal combustion engine, comprising:

a crankshaft;

a crank chamber accommodating said crankshaft;

an oil reservoir arranged adjacent to said crank chamber and containing engine oil; and at least one communicating channel having a flow resistance disposed between said crank chamber and said oil reservoir, said crank chamber and said oil reservoir being separated from each other by a partition wall, and said at least one communicating channel having said flow resistance comprising an orifice formed in said partition wall, said crank chamber and said oil reservoir always communicating with each other through said orifice, wherein said crank chamber and said oil reservoir and in communication with each other by way of said communicating channel, so that said flow resistance in said communicating channel causes a pressure in said oil reservoir to change with a delay with respect to a change in pressure in said crank chamber, a pressure difference between said crank chamber and said oil reservoir causing a fluid flow through said communicating channel from said crank chamber to said oil reservoir in a first instance and from said oil reservoir to said crank chamber in a second instance;

wherein said at least one communicating channel comprises a plurality of orifices disposed in said partition wall.

7. An internal combustion engine, comprising:

a crankshaft;

a crank chamber accommodating said crankshaft;

an oil reservoir arranged adjacent to said crank chamber and containing engine oil; and at least one communicating channel having a flow resistance disposed between said crank chamber and said oil reservoir, said crank chamber and said oil reservoir being separated from each other by a partition wall, and said at least one communicating channel having said flow resistance comprising an orifice formed in said partition wall, said crank chamber and said oil reservoir always communicating with each other through said orifice, wherein said crank chamber and said oil reservoir and in communication with each other by way of said communicating channel, so that said flow resistance in said communicating channel causes a pressure in said oil reservoir to change with a delay with respect to a change in pressure in said crank chamber, a pressure difference between said crank chamber and said oil reservoir causing a fluid flow through said communicating channel from said crank chamber to said oil reservoir in a first instance and from said oil reservoir to said crank chamber in a second instance;

wherein said partition wall is disposed within the oil reservoir.

8. An internal combustion engine, comprising:

a crankshaft;

a crank chamber accommodating said crankshaft;

an oil reservoir arranged adjacent to said crank chamber and containing engine oil; and at least one communicating channel having a flow resistance disposed between said crank chamber and said oil reservoir, said crank chamber and said oil reservoir being separated from each other by a partition wall, and said at least one communicating channel having said flow resistance comprising an orifice formed in said partition wall, said crank chamber and said oil reservoir always communicating with each other through said orifice, wherein said crank chamber and said oil reservoir and in communication with each other by way of said communicating channel, so that said flow resistance in said communicating channel causes a pressure in said oil reservoir to change with a delay with respect to a change in pressure in said crank chamber, a pressure difference between said crank chamber and said oil reservoir causing a fluid flow through said communicating channel from said crank chamber to said oil reservoir in a first instance and from said oil reservoir to said crank chamber in a second instance;

wherein said partition wall is formed in an arcuate shape about a rotational axis of the crankshaft.

9. An internal combustion engine, comprising:

a crankshaft;

a crank chamber accommodating said crankshaft;

a vibration member extending into said oil reservoir, wherein said vibration member is vibrated by operation of the engine;

an oil reservoir arranged adjacent to said crank chamber and containing engine oil; and at least one communicating channel having a flow resistance disposed between said crank chamber and said oil reservoir, said crank chamber and said oil reservoir being separated from each other by a partition wall, and said at least one communicating channel having said flow resistance comprising an orifice formed in said partition wall, wherein said crank chamber and said oil reservoir are in communication with each other by way of said communicating channel, so that said flow resistance in said communicating channel causes a pressure in said oil reservoir to change with a delay with respect to a change in pressure in said crank chamber, a pressure difference between said crank chamber and said oil reservoir causing a fluid flow through said communicating channel from said crank chamber to said oil reservoir.

* * * * *